US006811327B1

(12) United States Patent
Billet

(10) Patent No.: US 6,811,327 B1
(45) Date of Patent: Nov. 2, 2004

(54) CONNECTION SYSTEM FOR UNDERSEA ACOUSTIC ANTENNA

(75) Inventor: Daniel Billet, Tourette S/Loup (FR)

(73) Assignee: Thales Underwater Systems S.A.S., Sophia Antipolis (FR)

( * ) Notice: Subject to any disclaimer, the term of this patent is extended or adjusted under 35 U.S.C. 154(b) by 135 days.

(21) Appl. No.: 10/111,429

(22) PCT Filed: Nov. 7, 2000

(86) PCT No.: PCT/FR00/03094

§ 371 (c)(1),
(2), (4) Date: May 8, 2002

(87) PCT Pub. No.: WO01/37294

PCT Pub. Date: May 25, 2001

(30) Foreign Application Priority Data

Nov. 19, 1999 (FR) ..... 99 14598

(51) Int. Cl.[7] ..... G02B 6/36; H04B 10/00

(52) U.S. Cl. ..... 385/94; 385/88; 385/89; 398/140; 398/141

(58) Field of Search ..... 385/88, 89, 94; 398/140, 141

(56) References Cited

U.S. PATENT DOCUMENTS 4,023,887 A * 5/1977 Speers ..... 385/50
4,695,787 A 9/1987 Billet et al.
4,805,160 A * 2/1989 Ishii et al. ..... 367/134
4,835,747 A 5/1989 Billet et al.
4,838,797 A 6/1989 Dodier
5,015,061 A 5/1991 Giannini
5,451,856 A * 9/1995 Girard et al. ..... 318/807
6,453,377 B1 * 9/2002 Farnworth et al. ..... 710/300

FOREIGN PATENT DOCUMENTS

DE 38 02 661 8/1989

* cited by examiner

*Primary Examiner*—John R. Lee
*Assistant Examiner*—Paul M. Gurzo
(74) *Attorney, Agent, or Firm*—Oblon, Spivak, McClelland, Maier & Neustadt, P.C.

(57) ABSTRACT

A connection for an underwater acoustics system connecting elements of an antenna embedded in a leaktight first block of the system and an electro-optical transmitter embedded in a separate leaktight second block of the system. The antenna is electrically connected to a first part of a divisible transformer, which is also arranged in the leaktight first block. The electro-optical transmitter (e.g., vertical cavity surface emitting laser) is electrically connected to a second part of the divisible transformer, which is also arranged in the leaktight second block. The first part and the second part are anatomically separated, as are the first and second blocks within which they are contained, but have cores that can magnetically communicate with one another. By this configuration, the divisible transformer can communicate signals from the antenna to the electro-optical transmitter without compromising the leaktightness of the first or second blocks, thereby protecting the components.

6 Claims, 5 Drawing Sheets

CONNECTION SYSTEM FOR UNDERSEA ACOUSTIC ANTENNA

BACKGROUND OF THE INVENTION

1. Field of the Invention

The present invention relates to connection systems linking undersea acoustic antennas to electronic devices for interpreting acoustic signals. The electronic devices are situated within the hull of a submarine, while the antennas are situated outside the hull.

2. Background Art

The receiving antennas of sonars are generally situated outside a carrying vessel, a submarine for example, and are conventionally linked to electronic racks, which interpret the signals sent and received by these antennas, by electrical connections passing through the hull of the vessel. This arrangement entails numerous drawbacks, including a loss of leaktightness in the region of the connectors, a substantial number of cables, junction boxes, and pressure hull penetrators (PHP's), very high wiring costs, a reduced reliability by reason of the large number of devices used to establish these electrical connections, and finally a risk of a rupturing the leaktightness of the hull when it is necessary to replace one of the sensors.

For example, if it were desired to link a cylindrical antenna including 128 columns of 16 hydrophones, i.e., 2048 channels, using them all to carry out processing in azimuth and in then it would be necessary, between the antenna and the PHPs, to use 128 connectors on the columns and on the cables, 128 cables formed by 18 screened pairs, and 128 connectors on the cables and on the PHPs, i.e., 512 submerged connectors in total. As regards the PHPs, it would also be necessary to use 32 cables of 18 screened pairs fitted with 2 times 32 sockets, each socket including 4 connectors, 32 electronics boxes for conditioning the signals, and 32 cables fitted with 2 times 32 sockets for linking these conditioning boxes to the electronic rack.

Such an embodiment cannot be implemented in practice, by reason of the cost of the cabling, of the weight of the cables and connectors, which would be of the order of 6 tons, and of the very large number of PHPs and submerged connectors.

SUMMARY OF THE INVENTION

In order to use an antenna of this type, which is very useful for fine position-fixing of the sources of acoustic noise, and in order to overcome these drawbacks, the invention proposes a connection system for underwater acoustics. The connection system includes: elements of an antenna embedded in a leaktight first block of the system; a first part of a divisible transformer embedded in the first block, the first part electrically connected to the elements of the antenna; a second part of the divisible transformer embedded in a leaktight second block of the system, the second part magnetically continuous with the first part; and an electro-optical transmitter embedded in the second block and electrically connected to the second part. The first and second blocks are separated from one another, and the divisible transformer communicates signals from the elements of the antenna to the electro-optical transmitter without compromising the leaktightness of the first or second block.

According to another aspect of the invention, the electro-optical transmitter is a vertical cavity surface emitting laser (VCSEL).

Other features and advantages of the invention will become clearly apparent from the following description, given by way of non-limiting example with regard to the annexed figures.

DETAILED DESCRIPTION OF THE PREFERRED EMBODIMENTS

Figure 1:
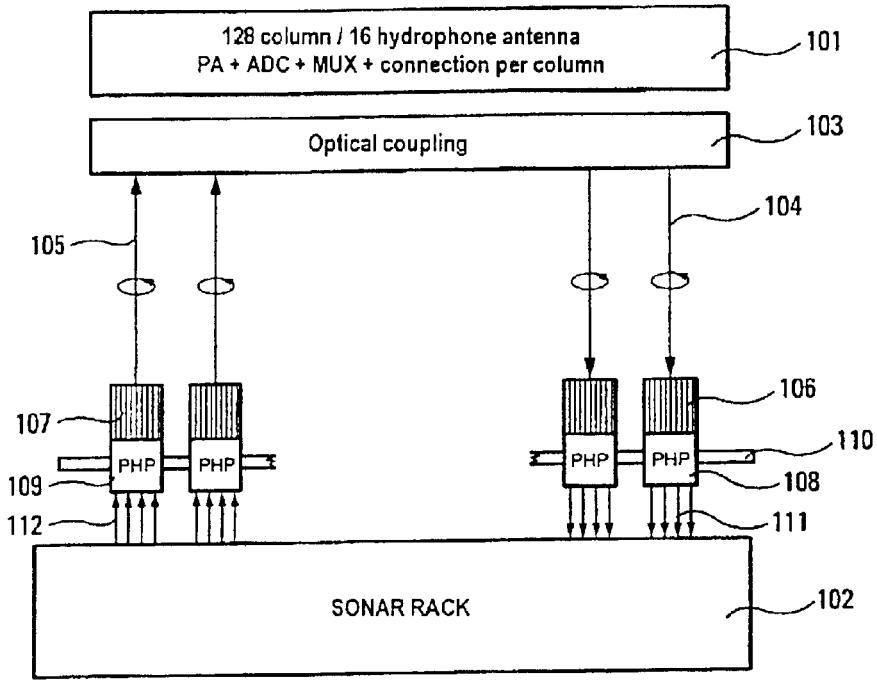
FIG. 1 is a theoretical diagram of a system according to the invention.

FIG. 1 illustrates a connection system of the invention, which links a cylindrical acoustic antenna 101 of the type set out above to a sonar rack 102. By way of example, each antenna comprises 128 columns of 16 hydrophones, plus the amplifiers (PA), the analog/digital converters (ADC), the multiplexers (MUX), and the connections corresponding to each column. These connections are linked by an optical-coupling system 103 to 8 sets of 8 optical fibers 104, which carry out the reception signals, and to 8 sets of 8 optical fibers 105, which carry in the control signals for the antenna. The extremities of these sets of optical fibers, which form cables, are overmolded onto optical/electrical converters 106 for the output signals and onto electrical/optical converters 107 for the control signals.

These converters are linked to through-hull connectors PHP, respectively 108 and 109 for the converters 106 and 107. These PHPs carry the signals within the thick hull 110 of a submarine. The PHPs 108 and 109 are then linked to the sonar rack 102 by way of cables 111 and 112.

Figure 2:
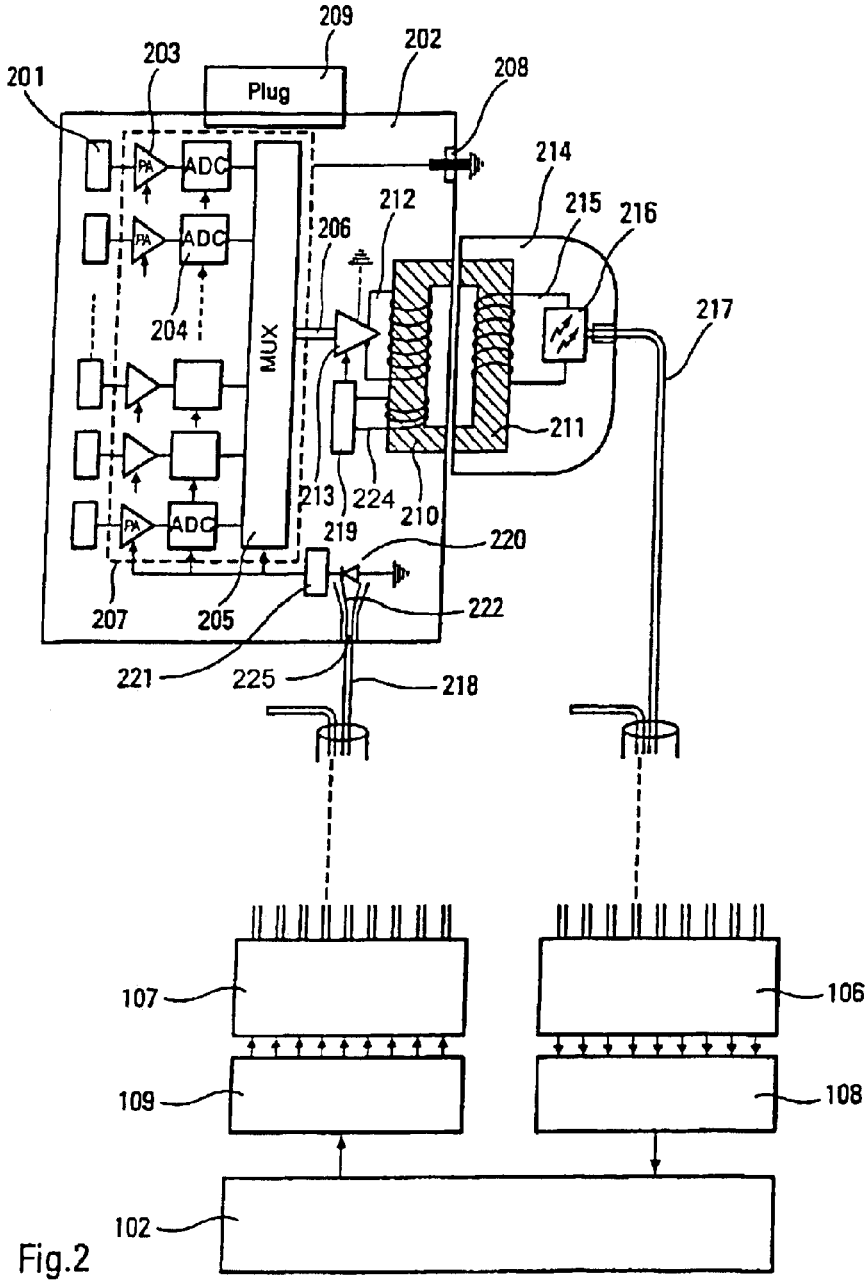
FIG. 2 is a diagram of one of the channels of FIG. 1.

FIG. 2 illustrates the set of connection elements corresponding to a column formed from 16 hydrophones 201 molded with their accompanying elements into a block 202 of plastic, which is transparent to the acoustic waves and conventionally formed of polyurethane. To each hydrophone 201 is linked an amplifier (PA) 203, itself linked to an analog/digital converter (ADC) 204. The set of these analog/digital converters is linked to a multiplexer (MUX) 205, which multiplexes the signals from all the hydrophones onto a single output 206. In this example, these hydrophones form one column of a cylindrical-type antenna, but this could be an acoustic antenna of any type, e.g., a flank antenna panel for a submarine or a segment of a towed linear acoustic antenna.

In this embodiment, the set of electronic circuits 203, 204, and 205 is enclosed in a metal box 207 which provides effective screening by being linked to earth via a leaktight earth coupling 208. The electrical power supply arrives via a lateral plug 209, itself leaktight. The box 207 is filled with a product that can withstand the hydrostatic pressure, for example an insulating mineral oil or a polyurethane like that which constitutes the block 202.

The digital data output by the multiplexer are extracted from the block 202 by the use of the divisible pulse transformer. The divisible transformer transmits the pulses, featuring a short time constant, and can be separated into two pieces. One piece 210 remains embedded in the mass of polyurethane 202. The other piece 211 remains outside this mass 202 and linked to the cable 217 for connection to the sonar rack 102. By this configuration, the whole of the antenna column and its accompanying elements embedded in block 202 can be connected to and disconnected from the block 214 containing the optical coupling 216, without rupturing the leaktightnes of either block 202 or block 214.

To accomplish this, the divisible transformer includes a divisible core of both a first internal part 210, which is embedded in the polyurethane block 202, and a second external part 211, which is embedded in the polyurethane block 214. The faces of the junction between the internal part 210 and the external part 211 form a gap but are relatively flush with the surfaces of the block 202 and the block 214, respectively.

A primary winding 212 is wound on the inner part 210 of the core. The winding 212 is fed by an amplifier 213, which receives the data supplied by the multiplexer 205. The second part 211 of the core is itself molded in polyurethane block 214. This second block 214 can be of different size than block 202 and can be fixed to the surface of the first block 202 by fixing means, not shown, clips or screws for example, so that the magnetic communication between the two parts 210 and 211 of the core is achieved optimally. Under these conditions, the magnetic flux induced by the primary winding 212 further induces, in a secondary winding 215 wound on the second part 211 of the magnetic core, a voltage representative of the signals leaving the multiplexer 205. This secondary winding 215 is linked to an electro-optical component 216, which makes it possible to convert these electrical signals into optical signals. This optical component can be a Vertical Cavity Surface Emitting Laser (VCSEL) component, which makes it possible to emit the light signals perpendicularly to its surface.

These light signals are then taken up by an optical fiber 217, which is overmolded into the second polyurethane block 214 in such a way that its extremity is just opposite from where the light signals leave the electro-optical component 216. The coupling between the fiber 217 and the component 216 can be achieved either directly, or by way of a waveguide, in order to facilitate manufacture of the assembly. With the material used to manufacture the second block 214 being transparent to light, there is no particular precaution to be taken, when overmolding, to avoid an interruption of the light-signal passage due to an infiltration of the overmolding product. The assembly thus forms a coupling between the column of hydrophones, equipped with its electronic matching elements, and the cable linking the assembly to the sonar rack 102.

The use of a VCSEL component is particularly beneficial, since the output mode of the light from this component allows easy matching to the optical transmission fiber, as already set out above. Furthermore, this component operates in current mode, and the value of this current is of about 1 mA with a consumption of the order of one milliwatt. This low current is particularly well suited to the transmission capabilities of the transformer described above. Furthermore, the wavelengths likely to be used can vary between 650 nm and 1100 nm, which are well adapted to transmission by optical fiber. In one preferred embodiment, a wavelength of 850 nm will be used. For further information on these types of component, reference may be made to the *IEEE Spectrum publication of February* 1998, page 43.

Even with a correct set-up, the dismantling of the blocks 202 and 214 cause a gap which is relatively large and exhibits fairly disperse characteristics, in particular as a consequence of the successive removal and refitting. The coupling between the primary winding 212 and secondary winding 215 of the transformer can therefore become relatively loose and not well defined. In order to make the electro-optical component 216 function with a modulation current adapted to these characteristics, a feedback system is used, including a feedback winding 224 wound on the first part 210 of the magnetic core of the transformer. This feedback winding 224, by way of a matching circuit, including a rectification system for example, makes it possible to control the gain of the amplifier 213.

Figure 4:
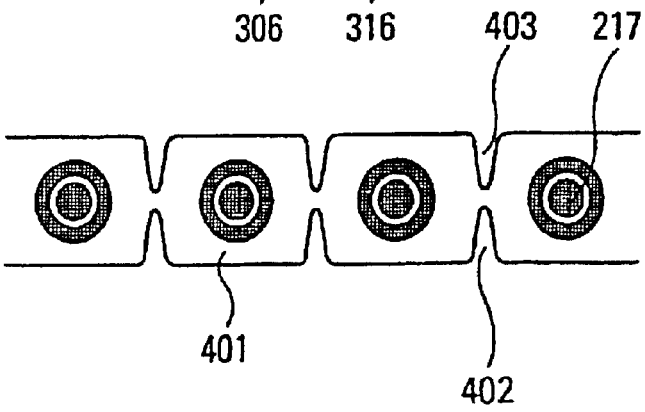
FIG. 4 is a cross-section of a layer of optical fiber used in the diagram of FIG. 2.

The optical fibers 217 corresponding to the various columns of the antenna are then grouped together into cables, which are linked to the device for gathering the optical data and for optical/electrical conversion 106. The invention produces these cables in the form of a flat cable, as represented in FIG. 4, which is formed by overmolding of the optical fibers 217 side-by-side in the form of a layer with a coating of polyurethane, to achieve continuity with the block 214. The overmolding features grooves 402 and 403 between the various fibers on each of the faces of the flat cable. This makes it possible to easily separate the fibers, complete with their coating, so as to facilitate fitting to the devices 106 by forming loops of slack as required.

A set of control signals, such as clock, synchronization, gain-control, etc., are sent to the electronic units 203–205 linked to the hydrophones. To accomplish this, the invention transmits these control signals via optical fibers 218, which are inserted into a blind hole 225 formed on one of the faces of the overmolding block 202 of the antenna. This hole 225 is situated facing a photodiode 220, which is driven by the light signals originating from the fiber 218. The electrical signals emitted by this diode 220 in response to these light signals are then decoded in a conditioning circuit 221, which selects the various signals necessary both for the amplifiers 203, the analog/digital converters 204, and the multiplexers 205. This selection takes place, for example, by decoding of a digital frame including all the necessary signals, according to a preestablished coding.

The fibers 218 originating from the device for electrical/optical conversion and distribution 107 of the optical signals are preferably assembled together in the form of a flat cable, like the optical fibers 217. In order to facilitate the coupling between the extremity of the fiber 218 and the photodiode 220, the invention proposes to use a "large-core fiber," which obtains a light beam 222 that is relatively wide, such that it can compensate for any defects in positioning and alignment between the extremity of the fiber 218 and the photodiode 220.

Figure 5:
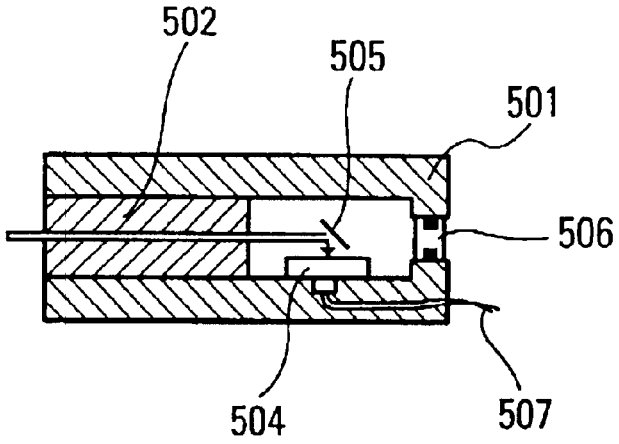
FIG. 5 is a sectional view of a system for connecting the optical fibers.
Figure 6:
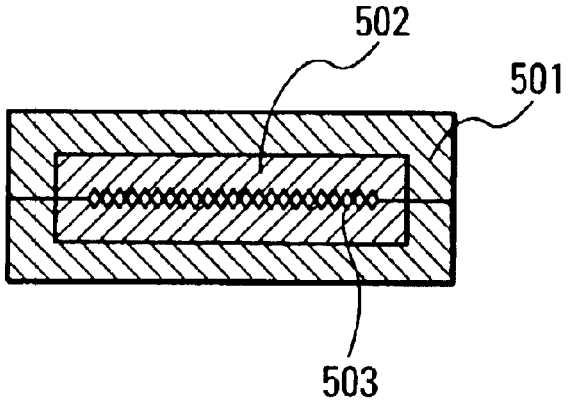
FIG. 6 is a front view of a system for connecting the optical fibers.

In order to connect the optical fibers 217 to the device 106, a small device is used like the one represented in longitudinal section in FIG. 5, and in transverse section in FIG. 6. This small device comprises a rectangular flat box 501 into which is inserted a piece 502 forming a fiber-clamping vice. This piece 502 comprises V-shaped longitudinal furrows, which hold the fibers 217 in the material 401 forming the flat cable after separation at the furrows 402 and 403. As this coating is soft, it molds into the furrows, which ensures leaktightness of the assembly in this region. The optical/electrical conversion system is formed by photodiodes 504 fixed on to the inner and lower face of the internal cavity delimited by the box 501. If appropriate, these photodiodes are assembled together into an Application Specific Integral Circuit (ASIC), which can integrate into this device a certain number of supplementary functions, thereby allowing, for example, amplification and/or multiplexing of the signals. To couple the fibers to the photodiodes, a mirror 505 may be used that is, for example, inclined at 45° and arranged between the extremity of the fibers and the input faces of the photodiodes.

The whole of the cavity is filled with a transparent, dielectric gel or an oil, in order to withstand the pressure outside the hull. This gel is inserted through an orifice, which is then closed off by a stopper 506. The electrical signals leave via screened pairs 507.

In another embodiment, this ASIC is produced in monolithic form, which makes it possible to use a waveguide integrated into the substrate of the ASIC, thereby making it further possible to couple the fibers directly to this waveguide. In this way, the mirror and the oil filling can be dispensed with.

In a similar fashion, the device for electrical/optical conversion and distribution of the optical control signals to the fibers 218 is produced with a device similar to that of FIGS. 5 and 6. The difference relates to the replacement of the receiving photodiodes by light-emitting diodes. In one preferred embodiment, components of the VCSEL type will be used in place of light-emitting diodes, such as the components 216 of FIG. 2.

Figure 3:
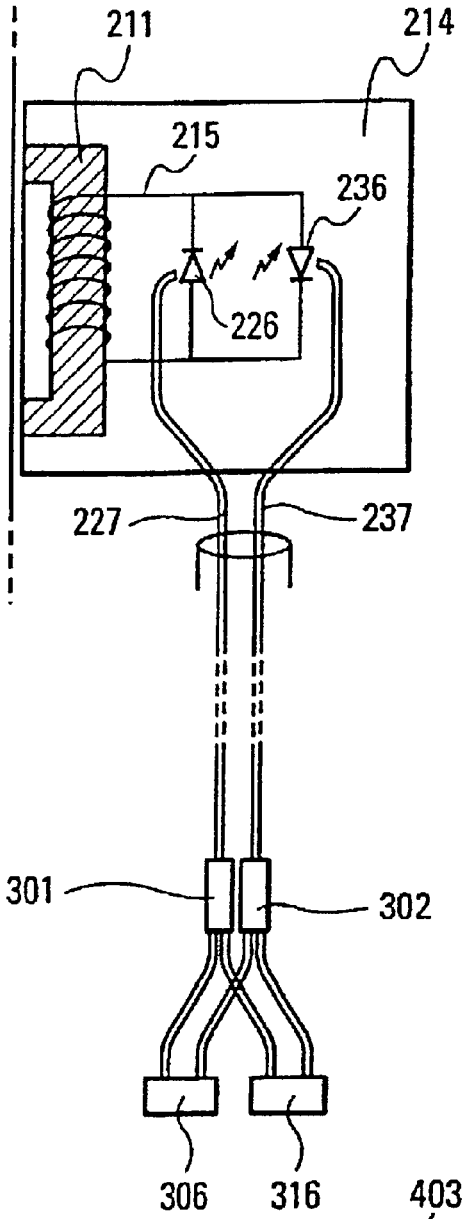
FIG. 3 is a diagram of an optical connection of FIG. 2.

In order to obtain redundancy of the system, which allows for fault tolerance, the invention also proposes, as represented in FIG. 3, to use two optical transmitters 226 and 236, e.g., DVCSELs wired in parallel on the terminals of the secondary winding 215. These components 226 and 236 are wired head-to-tail, such that the failure of one does not impair the operation of the other. These two components 226 and 236 are linked respectively to two optical fibers 227 and 237, which terminate on optical duplexers 301 and 302. Each of these duplexers are linked, respectively, to two pickup devices 306 and 316, which provide complete redundancy by always having the output signals from the transformer available on one of these two devices 306 and 316.

Figure 7:
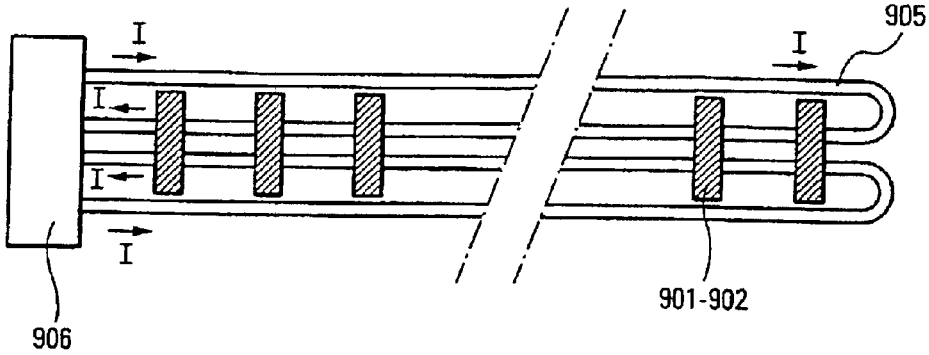
FIG. 7 is a top view of a set of supply sockets fixed onto the hull of a carrying vessel.
Figure 9:
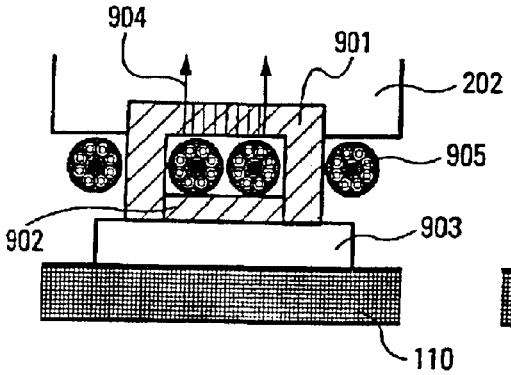
FIG. 9 is a sectional view of the cables of FIG. 7 in the region of a plug.
Figure 8:
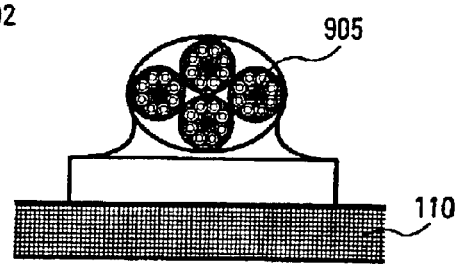
FIG. 8 is a sectional view of the cables of FIG. 7 between two plugs.

Finally, in order to obtain a system entirely without electrical contacts and entirely removable, the invention proposes to feed each antenna element 202 via an induction system, by means of a removable transformer, as represented in FIGS. 7, 8 and 9. To do that, the plug 209 of FIG. 2 is replaced by a part 901 of a magnetic core. The core includes this part 901 and a second part 902, which loop the magnetic circuit. The part 901 is U-shaped and embedded in the polyurethane block 202, while the part 902 is linear and closes the magnetic circuit. This part 902 is fixed onto a spacing piece 903, which itself is fixed to the hull 110 on to which the antenna is fixed. Thus, dispersion of the magnetic flux in this hull is avoided.

A secondary winding 904 wound on the part 901 of the magnetic circuit feeds the electronic elements embedded in the block 202. To feed the transformer, a primary winding is used, formed from multi-strand cables 905 that form loops, which pass through the hollow interior of the magnetic circuit 901/902 and are looped as represented in FIG. 7. These cables 905 are supplied with electrical energy from a junction box 906 which, in leaktight fashion, brings out the electrical energy from inside the hull 110. This junction box is preferably situated above the flotation line of the carrying vessel to facilitate repairs at this region. This flotation line, in the case of a submarine, being that in existence when the submarine is on the surface.

In order to have sufficient coupling, multi-strand cables, each strand of which is traversed by the same current, can be used, two in the case represented in the figures. In order to minimize the losses between the transformers, which form contactless electrical plugs, these cables are assembled together between these plugs, in the manner represented in FIG. 8.

What is claimed is:

1. An underwater acoustics system comprising:

elements of an antenna embedded in a leaktight first block of the system;

a first part of a divisible transformer embedded in the first block, the first part electrically connected to the elements of the antenna;

a second part of the divisible transformer embedded in a leaktight second block of the system; and an electro-optical transmitter embedded in the second block and electrically connected to the second part, wherein the first and second blocks are configured to be adjacent to one another so that the divisible transformer communicates signals from the elements of the antenna to the electro-optical transmitter without compromising the leaktightness of the first or second block.

2. The underwater acoustics system of claim 1, wherein the electro-optical transmitter is a vertical cavity surface emitting laser (VCSEL).

3. An underwater acoustics system comprising:

elements of an antenna embedded in a leaktight first block of the system;

an electro-optical transmitter embedded in a leaktight second block of the system that is separate from the first block;

first means for transforming first electrical signals received from the elements of the antenna to magnetic signals, and for transmitting the magnetic signals to the second block; and second means for transforming the magnetic signals received from the first transforming means to second electrical signals, and for transmitting the second electrical signals to the electro-optical transmitter, wherein the first and second means for transforming are embedded in the first and second blocks, respectively, and communicate signals from the elements of the antenna to the electro-optical transmitter without compromising the leaktightness of the first or second block.

4. The underwater acoustics system of claim 3, wherein the electro-optical transmitter is a vertical cavity surface emitting laser (VCSEL).

5. A method of connecting, in an underwater acoustics system, elements of an antenna embedded in a leaktight first block to an electro-optical transmitter embedded in a leaktight second block, the first and second blocks separate from one another, the method comprising:

transmitting first electrical signals from the elements of the antenna to a first part of a divisible transformer embedded in the first block;

transforming the first electrical signals to magnetic signals by the first part;

transmitting the magnetic signals from the first part of the divisible transformer to a second part of the divisible transformer embedded in the second block;

transforming the magnetic signals to second electrical signals by the second part;

transmitting the second electrical signals from the second part to the electro-optical transmitter, wherein the divisible transformer communicates the signals from the elements of the antenna to the electro-optical transmitter without compromising the leaktightness of the first block or second block.

6. The underwater acoustics system of claim 5, wherein the electro-optical transmitter is a vertical cavity surface emitting laser (VCSEL).

* * * * *